US007471304B2

(12) United States Patent
Ihara et al.

(10) Patent No.: US 7,471,304 B2
(45) Date of Patent: Dec. 30, 2008

(54) CARD MANUFACTURING METHOD AND APPARATUS THEREOF

(75) Inventors: Keiji Ihara, Kanagawa-ken (JP); Toshinori Takahashi, Kanagawa-ken (JP); Seiichi Tanabe, Tokyo-to (JP)

(73) Assignee: Victor Company of Japan, Limited, Yokohama-Shi (JP)

( * ) Notice: Subject to any disclaimer, the term of this patent is extended or adjusted under 35 U.S.C. 154(b) by 0 days.

(21) Appl. No.: 11/898,555

(22) Filed: Sep. 13, 2007

(65) Prior Publication Data

US 2008/0079799 A1 Apr. 3, 2008

(30) Foreign Application Priority Data

Sep. 28, 2006 (JP) ..... P2006-264249

(51) Int. Cl.
*B41J 2/325* (2006.01)

(52) U.S. Cl. ..... 347/213

(58) Field of Classification Search ..... 347/212, 347/213, 217, 171

See application file for complete search history.

(56) References Cited

U.S. PATENT DOCUMENTS 6,894,710 B2 * 5/2005 Suzuki et al. ..... 347/213
7,133,059 B2 * 11/2006 Mochizuki et al. ..... 347/213
7,349,002 B2 * 3/2008 Kanemaru et al. ..... 347/171

FOREIGN PATENT DOCUMENTS

JP 11-321166 11/1999
JP 2004-299300 10/2004

* cited by examiner

*Primary Examiner*—K. Feggins
(74) *Attorney, Agent, or Firm*—Nath Law Group; Jerald L. Meyer; Derek Richmond

(57) ABSTRACT

A card manufacturing method for manufacturing the card and a card manufacturing apparatus for manufacturing the card are provided. The card 51 includes a card base 1, a first receptor layer 1*a* arranged on one side of the card base 1 to contain a sublimation-ink image 8, a protecting layer OC1 laminated on the first receptor layer 1*a* and an invisible-ink image 10 formed on the protecting layer OC1. Owing to the interposition of the protecting layer OC1 between the sublimation-ink image 8 and the invisible-ink image 10, the card 51 is capable of suppressing color fading of a sublimation ink in the image 8 in spite of a card structure where the sublimation ink and an invisible ink are printed so as to overlap each other, allowing the card 51 to be used for a long time.

6 Claims, 8 Drawing Sheets

CARD MANUFACTURING METHOD AND APPARATUS THEREOF

BACKGROUND OF THE INVENTION

1. Field of the Invention

The present invention relates to a card manufacturing method for manufacturing the card and a card manufacturing apparatus for manufacturing the card. In particular, the present invention relates to a manufacturing method of a card having information printed thereon with the use of invisible ink that is not visible by visible light but fluorescent by light having a particular wavelength in order to prevent the card from being tampered or counterfeiting, and a manufacturing apparatus of the card.

2. Description of Related Art

In order to enhance the security of a card, hitherto, a variety of techniques for preventing interpolation and counterfeit of cards have been contemplated for practical use.

It is desired that such technologies is on a variety of cards, for instance, credit card, ID card, certificate card, etc.

As for a card as a personal identifier, it is often the case that the card has a facial portrait of the owner printed thereon. In this view, there is an increasing movement of adopting sublimation ink(s) suitable for photographic printing of high grade together with to a fusible ink suitable for characters in manufacturing the card.

As one technique of the security of a card, there is known an art of printing information (e.g. photo and data) so as to be invisible in a normal state with the use of an invisible ink that becomes visible under light having a given range of wavelength, for example, ultraviolet light although it is invisible under visible light.

Japanese Patent Laid-Open Publication No. 11-321166 discloses an instance of the technique of manufacturing a card with the use of both sublimation ink and invisible ink.

In the above publication, there is described an identification (ID) card having its security enhanced as a result of preventing the card from being tampered or counterfeiting. In detail, the ID card includes a card area having a facial portrait (image) printed with sublimation inks and inherent information printed on the card area with a fluorescent ink visible by irradiation of ultraviolet light (black light).

In manufacturing the card, the above publication discloses to use a sublimation transfer ribbon where sublimation dye layers in yellow (Y), magenta (M), cyan (C) and black (B) are laid on a ribbon base in this order and further, a fluorescent ink and a protecting layer are laid in succession to these sublimation dye layers.

SUMMARY OF THE INVENTION

In general, there is room for improvement in terms of the light stability of sublimation ink in comparison with fusible ink. In detail, the sublimation ink has a tendency to be discolored by its exposure to the light. Under such a situation, it has been desired to restore the color of the sublimation ink.

However, in case of a card where an invisible ink is overlaid on a card area having inherent information printed with sublimation inks, which is disclosed in the above publication, the sublimation inks are directly subjected to fluorescence whenever ultraviolet light is irradiated on the card in the process of confirming card's information printed with the invisible ink.

Therefore, there is fear that color fading of the sublimation inks is accelerated to deteriorate the printed image (e.g. facial portrait), causing a period of effective utilization of the card to be shortened disadvantageously.

Under such a circumstance, an object of the present invention is to provide a card which is capable of suppressing the color fading of a sublimation ink in spite of a structure where the sublimation ink and an invisible ink are printed so as to overlap each other in the same area of the card, allowing the card to be used for a long time. Further, another object of the present invention is to provide card manufacturing method and apparatus for manufacturing such a card.

In order to achieve the above object, there is provided a card manufacturing method for manufacturing a card with use of an intermediate transfer film in which a protecting layer and an ink receptor layer are laminated on a strip-shaped base in this order, the intermediate transfer film having a first transcriptional region and a second transcriptional region defined in common with the protecting layer and the ink receptor layer, and an ink film having respective ink areas formed on a film base successively, the ink areas having a plurality of sublimation-ink areas in different colors and an invisible-ink area, the card manufacturing method comprising: a sublimation-ink image forming process of transferring a plurality of sublimation inks in the sublimation-ink areas of the ink film to the ink receptor layer in the first transcriptional region of the intermediate transfer film in superimposition, thereby forming a sublimation-ink image in the intermediate transfer film; an invisible-ink image forming process of transferring an invisible ink in the invisible-ink area of the ink film to the ink receptor layer in the second transcriptional region of the intermediate transfer film, thereby forming an invisible-ink image in the intermediate transfer film; a first re-transfer process of re-transferring the ink receptor layer and the protecting layer in the first transcriptional region of the intermediate transfer film to a card base of the card so that the protecting layer in the first transcriptional region is arranged on a front side of the card; and a second re-transfer process of re-transferring the ink receptor layer and the protecting layer in the second transcriptional region of the intermediate transfer film onto the protecting layer in the first transfer are so that the protecting layer in the second transcriptional region is arranged on a front side of the card.

Further, there is also provided a card manufacturing apparatus comprising: an ink film having respective ink areas formed on a film base successively, the ink areas having a plurality of sublimation-ink areas provided with a plurality of sublimation inks in different colors and an invisible-ink area provided with an invisible ink; an intermediate transfer film in which a protecting layer and an ink receptor layer are laminated on a strip-shaped base in this order; a first detecting unit that detects the position of each of the ink areas of the ink film and outputs a first detection signal; a second detecting unit that detects a feeding position of the intermediate transfer film and outputs a second detection signal; a third detecting unit that detects a feeding position of a card base and outputs a third detection signal; a first feeding unit for feeding the ink film based on the first detection signal; a second feeding unit for feeding the intermediate transfer film based on the second detection signal; a third feeding unit for feeding the card base based on the third detection signal; a first transfer mechanism that presses the ink film against the intermediate transfer film and heats up the inks in the respective ink areas, thereby forming a transfer image in the ink receptor layer of the intermediate transfer film; second transfer mechanism that heats up the ink receptor layer having the transfer image formed therein and the protecting layer to re-transfer the ink receptor layer and the protecting layer to the card base; and a controller connected to all of the first detecting unit, the second detecting unit, the third detecting unit, the first feeding unit, the second feeding unit, the third feeding unit, the first transfer mechanism and the second transfer mechanism to control respective operations of the first transfer mechanism and the second transfer mechanism, wherein the controller controls the operation of the first transfer mechanism while controlling respective operations of the first feeding unit and the second feeding unit based on the first detection signal and the second detection signal so as to transfer the sublimation inks to the ink receptor layer in a first transcriptional region in the intermediate transfer film in superimposition thereby forming a first transfer image of the sublimation inks and further transfer the invisible ink to the ink receptor layer in a second transcriptional region in the intermediate transfer film, which is different from the first transcriptional region, thereby a second transfer image of the invisible ink; and the controller controls the operation of the second transfer mechanism while controlling respective operations of the second feeding unit and the third feeding unit based on the second detection signal and the third detection signal so as to re-transfer the ink receptor layer having the first transfer image formed therein in the first transcriptional region and the protecting layer to the card base and further re-transfer the ink receptor layer having the second transfer image formed therein in the second transcriptional region and the protecting layer onto the protecting layer in the first transcriptional region on the card base.

DETAILED DESCRIPTION OF THE PREFERRED EMBODIMENT

There will be below described several embodiments of the present invention with reference to FIGS. 1A to 11.

1st. Embodiment

In this embodiment, using an ink film having ink layers (e.g. sublimation inks) formed in sequence, the ink is directly printed on a card base to be printed, forming a card. This printing operation is referred to as "direct printing process".

Figure 1A:
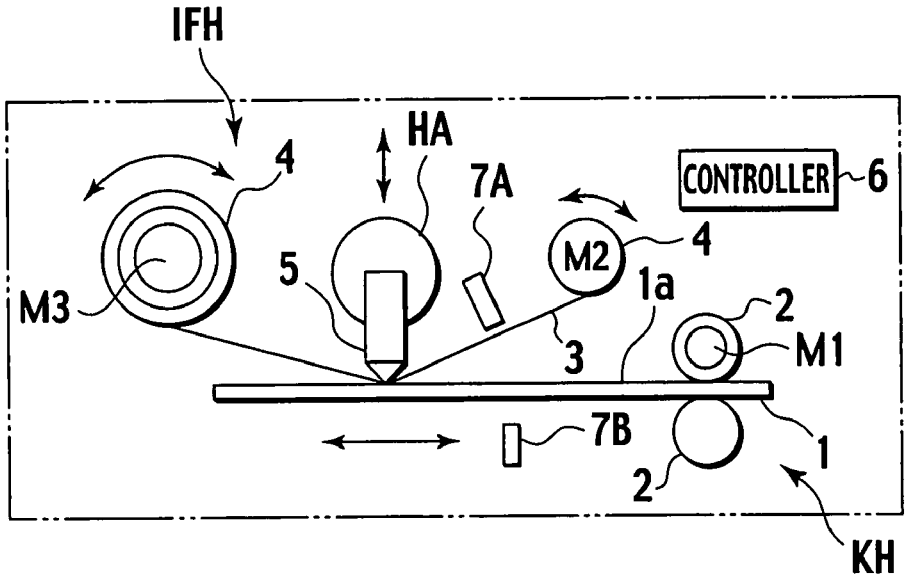
FIG. 1A is a schematic structural view explaining a card manufacturing apparatus in accordance with a first embodiment of the present invention.
Figure 1B:
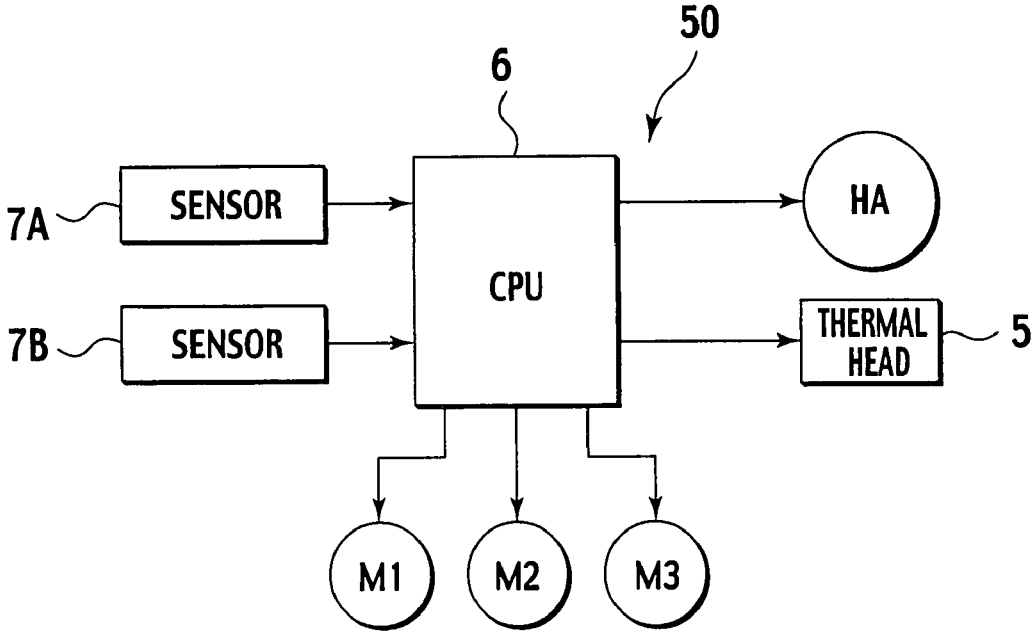
FIG. 1B is a block diagram of the card manufacturing apparatus.

FIG. 1A is a schematic structural view of a card manufacturing apparatus 50 performing the above direct printing process. FIG. 1B is a schematic block diagram of the card manufacturing apparatus 50.

This card manufacturing apparatus 50 comprises a card feeder (feeding unit) KH having a motor M1 as a feeder driving source for the card base 1 and a pair of pinch rollers 2, 2 connected to a motor M1 to feed the card base 1 while pinching it therebetween, a sensor (detecting unit) 7B for detecting a feeding position of the card base 1, an ink-film feeder (feeding unit) IFH having a pair of reels 4 for winding and rewinding a later-mentioned ink film 3 and motors M2, M3 for rotating the reels 4, 4 respectively, a sensor (detecting unit) 7A for detecting later-mentioned position marks PM1 to PM7, which are marked on the ink film 3 in order to specify the positions of respective ink layers, in non-contact manner, a thermal head 5 for heating up the ink film 3 to sublimate the sublimation inks, a head actuator (transfer mechanism) HA for moving the thermal head 5 vertically (in FIG. 1A) so that the ink film 3 is pressed on the card base 1, and a controller 6 for controlling the operation of the whole apparatus 50.

In the embodiment, the card base I is provided, on one surface thereof, with a receptor layer 1*a* for receiving the sublimation inks.

Figure 2:
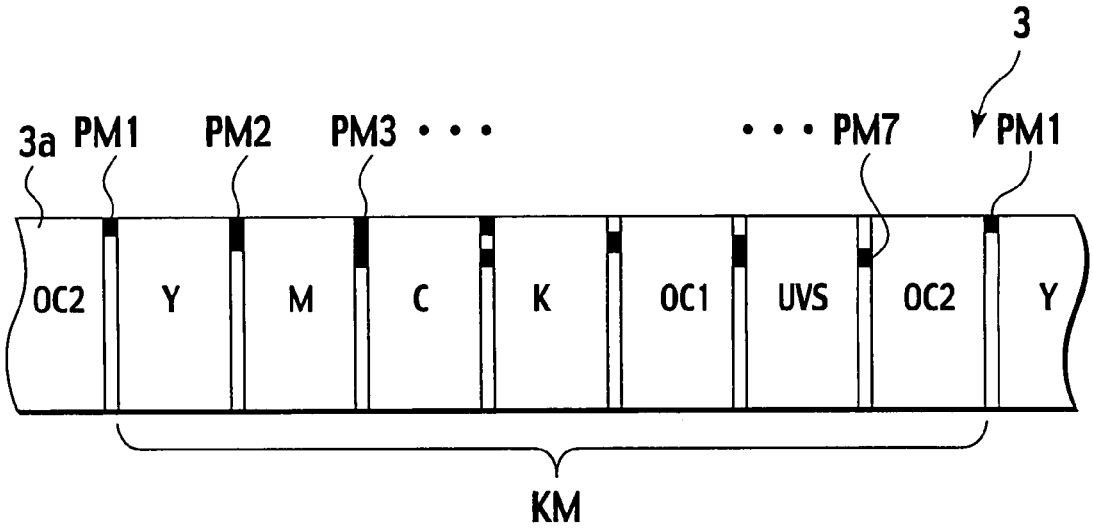
FIG. 2 is a plan view explaining an ink film used in the card manufacturing apparatus of the first embodiment of the present invention.

As shown in FIG. 2, the ink film 3 has a strip-shaped base sheet 3*a*, sublimation-ink layers, a fusible-ink layer, protecting-ink layers and an ultraviolet-emitting-ink (invisible ink) layer all formed on one of the base sheet 3*a*, in sequence.

Hereinafter, these layers of the ink film 3 might be referred to as "sublimation-ink areas", "fusible-ink area", "first protecting-ink area" "sublimation ultraviolet-emitting-ink (invisible-ink) area" and "second protecting-ink area", respectively.

In detail, a plurality of groups of layers (KM) are formed in the longitudinal direction of the ink film 3 successively. Each group of layers (KM) comprises respective sublimation-ink layers Y, M, C in yellow (Y), magenta (M) and cyan (C), a fusible-ink layer K in black, a first protecting-ink layer OC1, a sublimation ultraviolet-emitting-ink layer UVS and a second protecting-ink layer OC2, in sequence in the longitudinal direction of the ink film 3

The first protecting-ink layer OC1 and the second protecting-ink layer OC2 may be made of acrylate resin, polyester resin, polyurethane resin or the like. Further, as ultraviolet absorbents for the protecting-ink layers, there may be added organic absorbent, for example, benzophenone compound, benzotriazole compound and anilide-oxalate compound, or inorganic absorbent of metal oxide.

For the purpose of allowing the sensor 7A to detect the positions of respective ink layers, the ink film 3 is also provided with a plurality of positioning marks PM1 to PM7 corresponding to the ink layers respectively.

In operation, the controller 6 controls the operation of the card feeder KH to feed the card base 1 so that a print starting position designated on the card base 1 is aligned with the thermal head 5 (cueing of the card base 1).

Based on detection signals from the sensor 7A detecting the positioning marks PM1 to PM7, the controller 6 further controls the operation of the ink-film feeder IFH so that an ink layer corresponding to a certain color to be printed in accordance with a required printing content (e.g. yellow as the first printed color) is aligned with the thermal head 5 (i.e. cueing operation of the ink layer).

Corresponding to the above positioning of the card base 1 and the ink film 3, additionally, the controller 6 drives the head actuator HA to feed the card base 1 and the ink film 3 while allowing the thermal head 5 to pushing the ink film 3 onto the card base 1. Simultaneously, the controller 6 drives the head actuator HA to heat up the thermal head 5 for sublimating or melting respective inks on the ink layers, so that a designated print image is printed on the card base 1.

After that, the cueing operations of the card base 1 and an ink layer of color to be next-printed in the ink film 3 are repeated. In this way, the inks in several colors, the protecting inks and the ultraviolet emitting inks are successively printed on the card base 1, in lamination.

Figure 3:
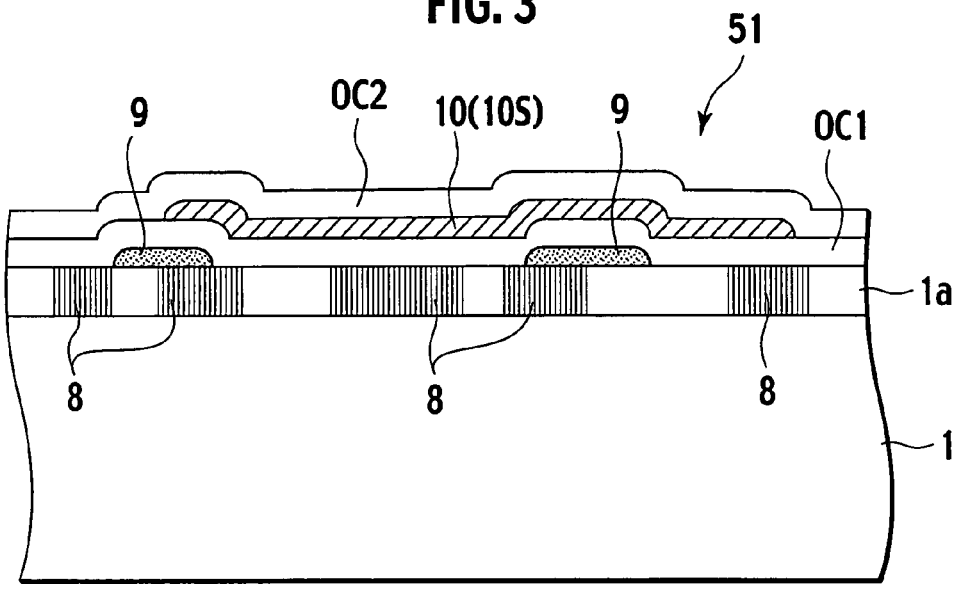
FIG. 3 is a sectional view showing a card in accordance with the first embodiment of the present invention.

Next, this lamination-printing (referred to as "trapping") will be described with reference to FIG. 3, in detail. FIG. 3 is a schematic sectional view showing a printing area on a card 51 of the first embodiment.

First, using the sublimation-ink layers Y, M, C, the printing of respective colors is applied on the card base 1. Consequently, a sublimation-ink image 8 is formed in the receptor layer 1*a*. This image is suitable for a facial portrait since the image could be printed in full-color printing with high quality.

Next, the printing operation using the fusible-ink layer K in black is performed. Thus, a fusible-ink image 9 is formed on the surface of the receptor layer 1*a*. This image is suitable for characters and marks since the image could be printed in black remarkably clearly.

Next, the printing operation of the first protecting-ink layer OC1 is carried out against the whole surface of the printing area including the fusible-ink image 9. In this way, the entire printing area including the fusible-ink image 9 is covered with the first protecting-ink layer OC1.

Next, the printing operation using the ultraviolet-emitting-ink layer UVS is carried out. Thus, a designated invisible-ink image (ultraviolet emitting ink image) 10 is printed on the first protecting-ink layer OC1. This image is suitable for personal data (name, birthday, finger print, etc.).

Next, the printing operation of the second protecting-ink layer OC2 is carried out against the whole surface of the printing area including the invisible-ink image (ultraviolet emitting ink image) 10.

In this way, the card 51 is completed through the above-mentioned printing processes.

In the shown embodiment, an invisible-ink layer 10*s* (as one layer of the invisible-ink image 10) is arranged apart from the card base 1 in comparison with the receptor layer 1*a* including the sublimation-ink image 8 and additionally, the first protecting-ink layer OC1 as one protecting layer is interposed between the sublimation-ink image 8 and the invisible-ink layer 10*s*.

Accordingly, as the sublimation-ink image 8 does not abut on the invisible-ink image 10 (image of ultraviolet emitting ink) directly, the light intensity of fluorescence, which is radiated from the invisible-ink image 10 onto the sublimation-ink image 8 in irradiating ultraviolet light in order to make the invisible-ink image 10 visible, is reduced in diffusion by the fluorescence's transmitting through the first protecting-ink layer OC1, so that the color of the sublimation ink is restored to maintain the sublimation-ink image 8 in a good condition for a long period.

It is noted that if the ultraviolet emitting ink (fluorescent ink) makes contact with the sublimation ink, there is a possibility that the color degradation of the sublimation ink is promoted due to the cross-reaction of both inks. However, according to the embodiment, both of the ultraviolet emitting ink and the sublimation ink are separated from each other through the first protecting-ink layer OC1, so that the color degradation of the sublimation ink can be prevented to maintain the sublimation-ink image 8 in a good condition for a long period.

Moreover, if the first protecting-ink layer OC1 is mixed with either known ultraviolet absorbent or known ultraviolet diffusing agent, it is also possible to suppress an influence of ultraviolet rays on the sublimation-ink image 8.

Further, as the invisible-ink image 10 is arranged closer to the surface of the card 51 in comparison with the sublimation-ink image 8 and the fusible-ink image 9, it is possible to make the fluorescence of the invisible-ink image 10 visible more clearly.

Modification of 1$^{st}$. Embodiment

Figure 4:
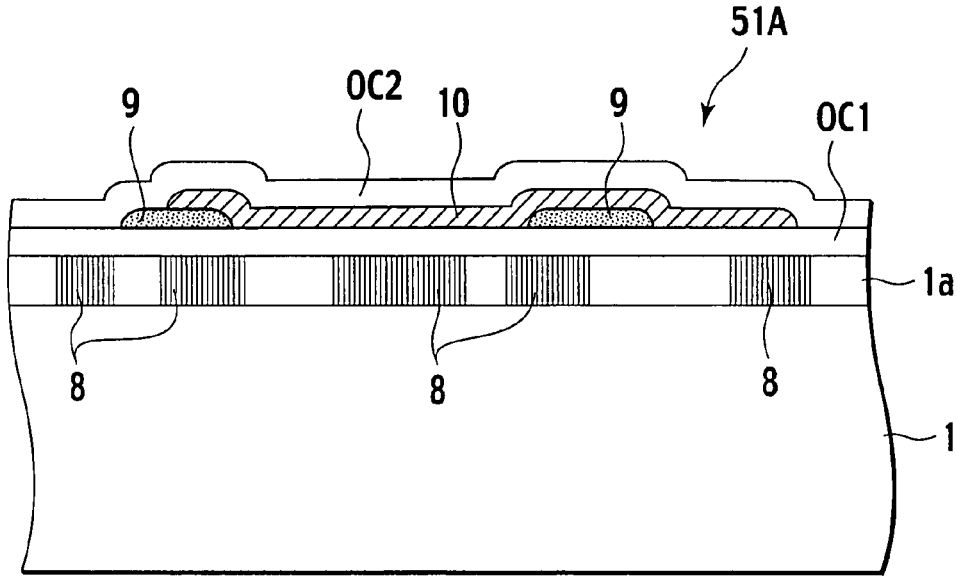
FIG. 4 is a sectional view showing a card of a modification of the first embodiment of the present invention.

FIG. 4 shows a card 51A in one modification of the first embodiment. The modification differs from the first embodiment in the position of the fusible-ink image 9.

We now describe the printing process for the card 51A in detail.

With the use of the sublimation-ink layers Y, M, C, it is firstly performed to print respective colors of Y, M, C on the card base 1. Consequently, a sublimation-ink image 8 is formed in the receptor layer 1*a*.

Next, the printing operation of the first protecting-ink layer OC1 is applied on the whole surface of the printing area including the sublimation-ink image 8. As a result, the sublimation-ink image 8 is covered with the first protecting-ink layer OC1.

Successively, the printing operation in black is performed with the use of the fusible-ink layer K. Thus, a fusible-ink image 9 is formed on the surface of the first protecting-ink layer OC1.

Next, the printing operation is performed with the use of the ultraviolet-emitting-ink layer UVS. Thus, a designated invisible-ink image (ultraviolet emitting ink image) 10 is printed on the fusible-ink image 9 and the first protecting-ink layer OC1 except its portions having no fusible-ink image.

Next, the printing operation of the second protecting-ink layer OC2 is applied on the whole surface of the printing area including the fusible-ink image 9 covered with no invisible-ink image, the invisible-ink image (ultraviolet-emitting-ink image) 10 and the remaining the first protecting-ink layer OC1.

In this way, the card 51A is completed through the above-mentioned printing processes.

In this modification also, the receptor layer 1*a* including the sublimation-ink image 8 is arranged close to the card base 1 in comparison with the layer including the invisible-ink image 10 and additionally, the first protecting-ink layer OC1 as one protecting layer is interposed between the receptor layer 1*a* and the above layer including the invisible-ink image 10.

Accordingly, as the sublimation-ink image 8 does not abut on the invisible-ink image 10 (image of ultraviolet emitting ink) directly, the light intensity of fluorescence, which is radiated from the invisible-ink image 10 onto the sublimation-ink image 8 in irradiating ultraviolet light in order to make the invisible-ink image 10 visible, is reduced in diffusion by the fluorescence's transmitting through the first protecting-ink layer OC1, so that the color of the sublimation ink is restored to maintain the sublimation-ink image 8 in a good condition for a long period.

It is noted that if the ultraviolet emitting ink (fluorescent ink) makes contact with the sublimation ink, there is a possibility that the color degradation of the sublimation ink is promoted due to the cross-reaction of both inks. However, according to the embodiment, both of the ultraviolet emitting ink and the sublimation ink are separated from each other through the first protecting-ink layer OC1, so that the color degradation of the sublimation ink can be prevented to maintain the sublimation-ink image 8 in a good condition for a long period.

Moreover, if the first protecting-ink layer OC1 is mixed with either known ultraviolet absorbent or known ultraviolet diffusing agent, it is also possible to suppress an influence of ultraviolet rays on the sublimation-ink image 8.

Further, as the invisible-ink image is arranged closer to the surface of the card in comparison with the sublimation-ink image 8 and the fusible-ink image 9, it is possible to make the fluorescence of the invisible-ink image 10 visible more clearly.

$2^{nd}$. Embodiment

In this embodiment, using an ink film having ink layers (e.g. sublimation ink) formed in sequence, the ink in the form of an image is transferred to an intermediate transfer film having an ink receptor layer and subsequently, the so-transferred image is further transferred onto a card base to be printed, forming a card. This printing operation is called to as "re-transfer printing process".

Figure 5A:
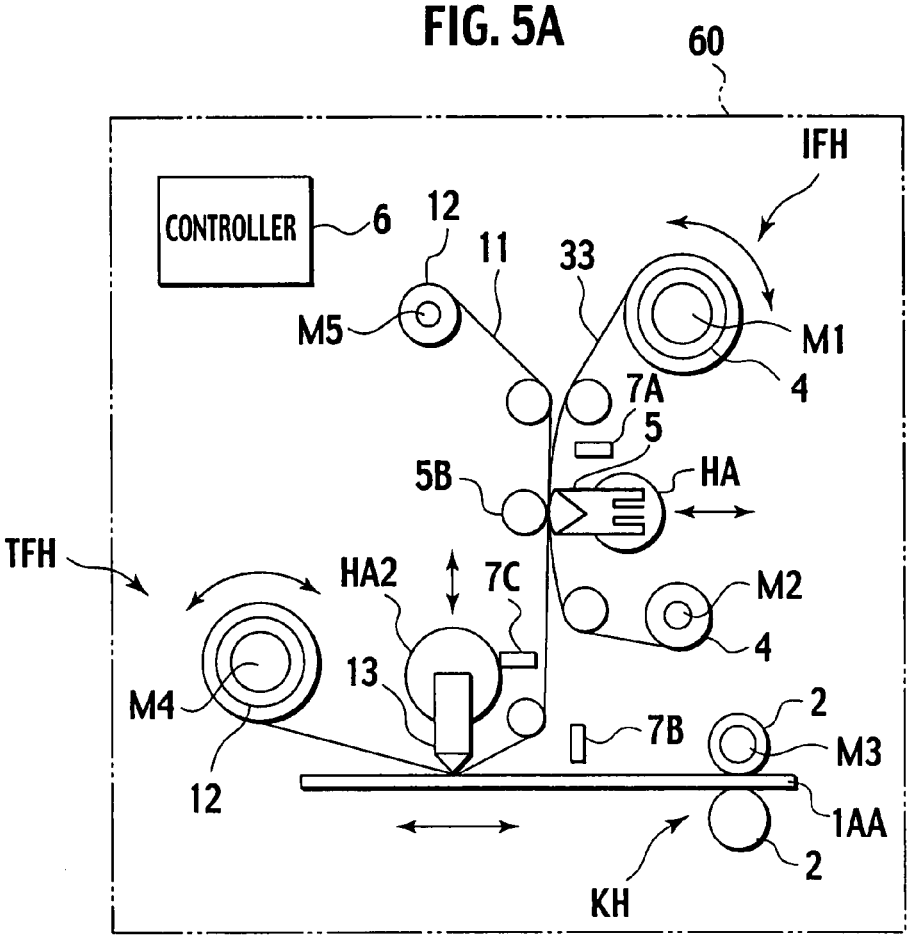
FIG. 5A is a schematic structural view explaining a card manufacturing apparatus in accordance with a second embodiment of the present invention.
Figure 5B:
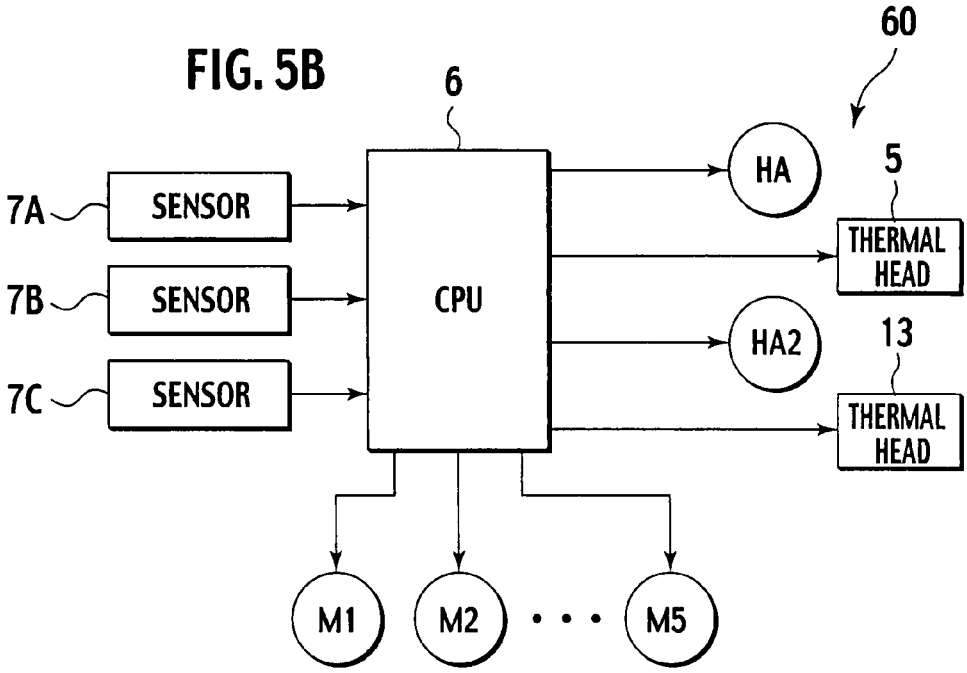
FIG. 5B is a block diagram of the card manufacturing apparatus.

As shown in FIGS. 5A and 5B, a card manufacturing apparatus 60 comprises a card feeder KH (as the third feeding mechanism of the invention) having a motor M3 as a feeder driving source for a card base 1AA and a pair of pinch rollers 2, 2 connected to the motor M3 to feed the card base 1AA while pinching it therebetween, a sensor 7B (as the third detecting unit of the invention) for detecting a feeding position of the card base 1AA, an ink-film feeder IFH (as the first feeding mechanism of the invention) having a pair of reels 4, 4 for winding and rewinding a later-mentioned ink film 33 and motors M1, M2 for rotating the reels 4, 4 respectively, a sensor 7A (as the first detecting unit of the invention) for detecting later-mentioned position marks PM11 to PM15, which are marked on the ink film 33 in order to specify the positions of respective ink layers, in non-contact manner, a thermal head 5 for heating up the ink film 33 to sublimate the sublimation ink or melt the fusible ink, a head actuator HA (as the first transfer mechanism of the invention) for moving the thermal head 5 horizontally (in FIG. 5A) so that the ink film 33 is pressed on an intermediate transfer film 11 (mentioned later) between a roller 5B and the thermal head 5, and a controller 6 for controlling the operation of the whole apparatus 60.

Further, the card manufacturing apparatus 60 includes an intermediate-transfer-film feeder TFH (as the second feeding mechanism of the invention) having a pair of reels 12, 12 for winding and rewinding the intermediate transfer film 11 and motors M4, M5 for rotating the reels 12, 12, a sensor 7C (as the second detecting unit of the invention) for detecting positioning marks that are marked on the intermediate transfer film 11 in order to specify its transfer position, in non-contact manner, a thermal head 13 for heating up the intermediate transfer film 11 to sublimate the sublimation ink or melt the fusible ink, a head actuator HA2 (as the second transfer mechanism of the invention) for moving the thermal head 13 vertically (in FIG. 5A) so that the intermediate transfer film 11 is pressed on the card 1AA.

Figure 6:
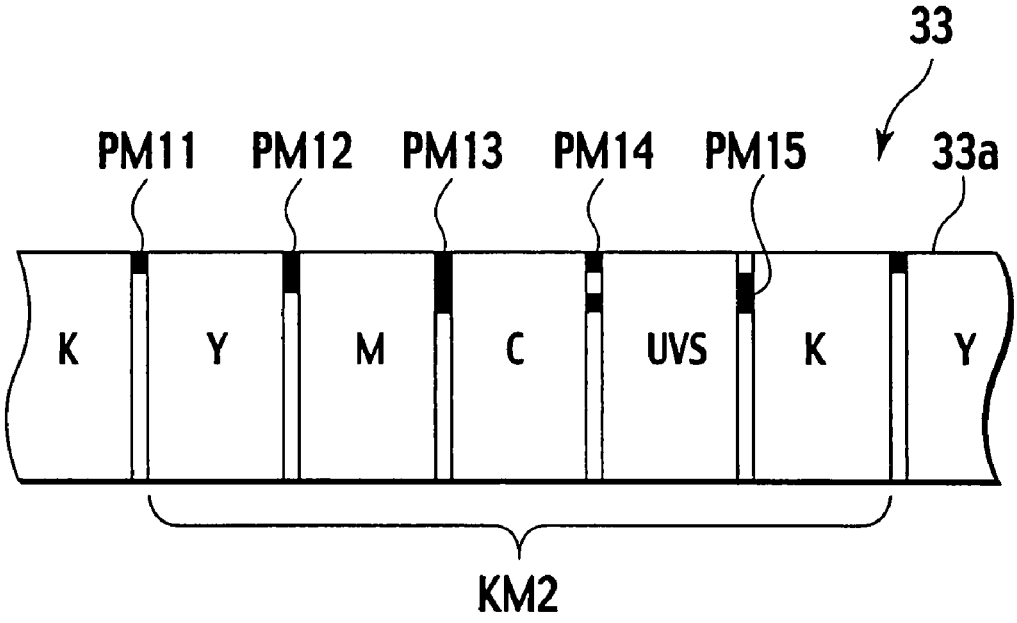
FIG. 6 is a plan view explaining an ink film used in the card manufacturing apparatus of the second embodiment of the present invention.

As shown in FIG. 6 (partial plan view), the ink film 33 has a strip-shaped base sheet 33*a*, sublimation-ink layers Y, M, C, an ultraviolet-emitting-ink layer UV and a fusible-ink layer K all formed on one surface of the base sheet 33*a* in sequence.

Hereinafter, these layers on the ink film 33 might be referred to as "fusible-ink areas", "sublimation ultraviolet-emitting-ink (invisible-ink) area" and "fusible-ink area", respectively.

In detail, a plurality of groups (KM2) of various layers are formed in the longitudinal direction of the ink film 33 repeatedly. Each of the groups (KM2) comprises respective sublimation-ink layers Y, M, C in yellow (Y), magenta (M) and cyan (C), a sublimation ultraviolet-emitting-ink layer UVS and a fusible-ink layer K in black, all of which successively arranged in the longitudinal direction of the ink film 33, in this order.

For the purpose of allowing the sensor 7A to detect the positions of respective ink layers, the ink film 33 further includes positioning marks PM11 to PM15 corresponding to the ink layers respectively.

Figure 7:
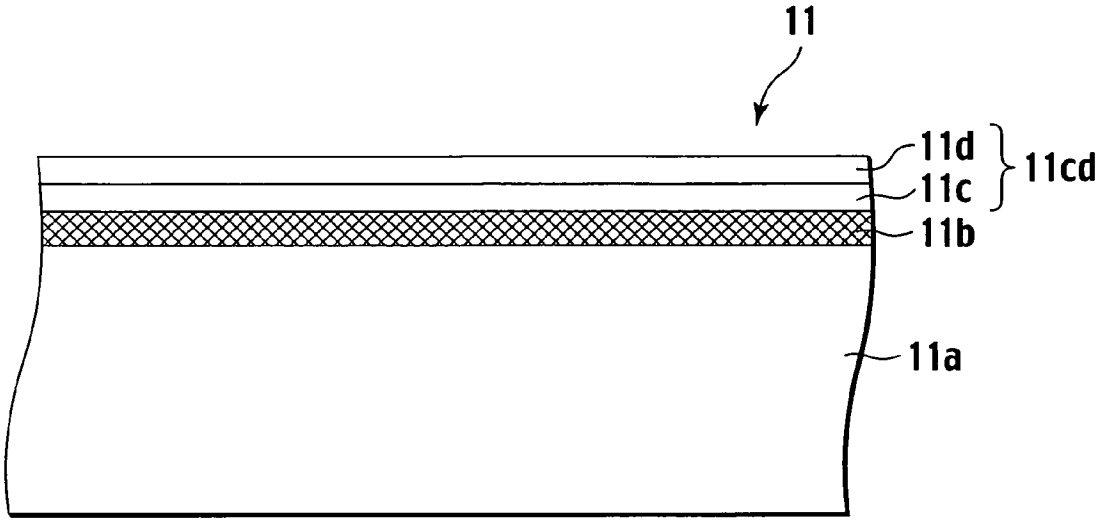
FIG. 7 is a sectional view explaining an intermediate transfer film used in the card manufacturing apparatus of the second embodiment of the present invention.

While, as shown in FIG. 7, the intermediate transfer film 11 includes a strip-shaped base 11*a*, a release layer 11*b* laminated on the base 11*a*, a protecting layer 11*c* on the release layer 11*b* and an ink receptor layer 11*d* on the protecting layer 11*c*.

In these laminated layers, both the protecting layer 11*c* and the ink receptor layer 11*d* on the front side constitute a transfer layer 11*cd* of the intermediate transfer film 11. The above release layer 11*b* is provided to facilitate a peeling of the transfer layer 11*cd*.

For instance, the protecting layer 11*c* is made of polyurethane resin, acrylate resin, polyethylene resin or the like.

Based on output signals from the sensors 7A, 7C, the controller 6 carries out the cueing operation of the intermediate transfer film 11 (i.e. cueing of a film's unused area on which an ink is to be transferred) and the cueing operation of the ink film 33, in detail, the cueing of a film's first ink layer (e.g. yellow) of an image to be transferred on the unused area. That is, the controller 6 drives the ink-film feeder IFH and the intermediate-transfer-film feeder TFH so that respective cueing positions of the films 11, 33 are aligned with the thermal head 5.

In association with the positioning of the films 11, 33, the controller 6 drives the head actuator HA to transfer these films 11, 33 while pinching them between the thermal head 5 and the roller 5B. Simultaneously, the controller 6 heats up the thermal head 5 to sublimate inks in order to transfer a designated image on the intermediate transfer film 11.

Then, this transfer operation is completed since the sublimated inks are retained in the ink receptor layer 11*d* of the intermediate transfer film 11.

Figure 8:
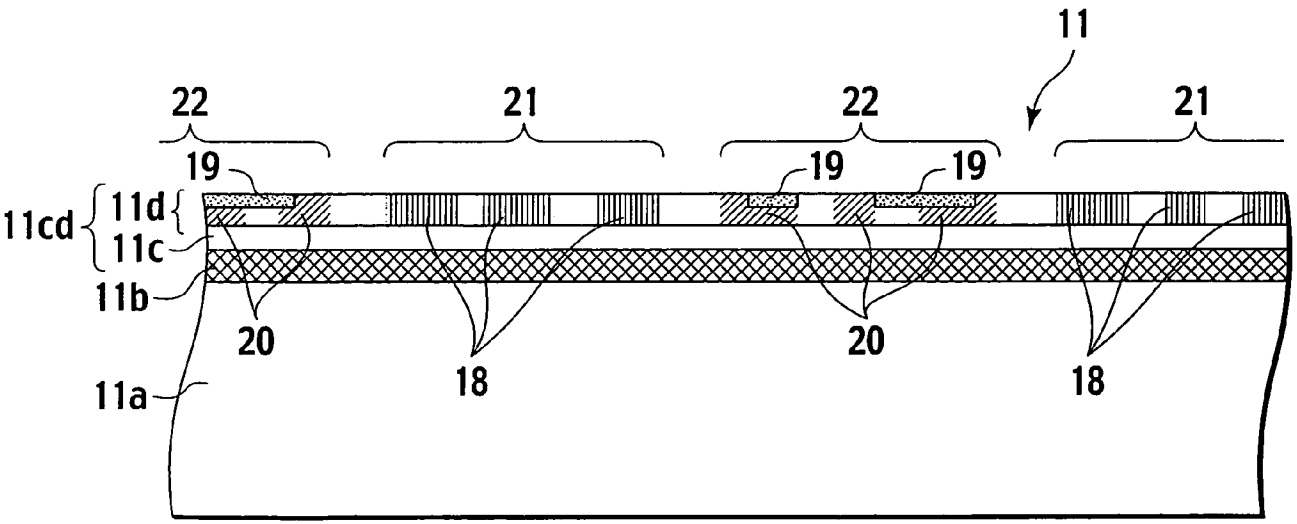
FIG. 8 is a sectional view explaining a transfer process in the second embodiment of the present invention.

FIG. 8 is a schematic sectional view of the intermediate transfer film 11 after the inks have been transferred. In transferring the inks to the intermediate transfer film 11, respective sublimation colors Y, M, C are transferred into the first transcriptional region 21 of the same area, in piles.

On the other hand, respective inks of both the sublimation ultraviolet-emitting-ink layer UVS and the fusible-ink layer K are transferred into a second transcriptional region 22 abutting on the first transcriptional region 21 through a regular interval, in piles.

Thus, as for the sublimation inks, the cueing operation of the first transcriptional region 21 and respective colors in the ink film 33 is repeated, so that respective inks in plural colors Y, M, C are transferred into the ink receptor layer 11*d* (11*d*1) of the first transcriptional region 21. As a result, the sublimation-ink image 18 is formed in the ink receptor layer 11*d*

(11*d*1). (i.e. the sublimation-ink image forming process of the invention) This image is suitable for a facial portrait since the image could be printed in full-color printing with high quality.

At each of the second transcriptional regions 22, the ink in the sublimation ultraviolet-emitting-ink layer UVS is firstly transferred into the ink receptor layer 11*d* (11*d*2), forming the invisible-ink image 20 (i.e. the invisible-ink image forming process of the invention). In succession, the ink in the fusible-ink layer K is transferred onto the invisible-ink image 20, so that the fusible-ink image 19 is laminated on the invisible-ink image 20, in piles.

Accordingly, the later-transferred fusible-ink image 19 is formed on the front side of the ink receptor layer 11*d* in each second transcriptional region 22.

Hereinafter, the ink receptor layer (portion) 11*d* in the first transcriptional region 21 and the ink receptor layer (portion) 11*d* in the second transcriptional region 22 are indicated with reference signs 11*d*1, 11*d*2, respectively. Similarly, the protecting layer (portion) 11*c* in the first transcriptional region 21 and the protecting layer (portion) 11*c* in the second transcriptional region 22 are indicated with signs 11*c*1, 11*c*2, respectively.

In this way, respective positions for the first and second transcriptional regions 21, 22 containing the ink images 18~20 are established in the intermediate transfer film 11 previously. Further, the intermediate transfer film 11 is provided, between each first transcriptional region 21 and each second transcriptional region 22 (and between the second transcriptional region 22 and the first transcriptional region 21), with positioning marks PM16, PM 17 for specifying the transcriptional regions 21, 22. These positioning marks are detected by the sensor 7C, while the controller 6 judges the positions of the marks on the basis of the detection signals from the sensor 7C.

The ink images 18~20 transferred to the intermediate transfer film 11 in the above way are re-transferred to a card base 1AA.

Based on the positional information of the card base 1AA detected by the sensor 7B, the controller 6 controls the operation of the card feeder KH so as to cue the re-transfer area on the card base 1AA.

This cueing operation is performed so as to align a re-transfer starting position defined on the card base 1AA with the thermal head 13 (see FIG. 5A).

Based on the detection signal from the sensor 7C, the controller 6 further controls the operation of the intermediate-transfer-film feeder TFH so that, as a film's area to be re-transferred preferentially, the first transcriptional region 21 is selected from the first and second transcriptional regions 21, 22 of the intermediate transfer film 11 and additionally, the re-transfer starting position of the first transcriptional region 21 is aligned with the thermal head 13.

Corresponding to the alignment of the intermediate transfer film 11 with the card base 1AA, the controller 6 drives the head actuator HA2 to transfer both of the intermediate transfer film 11 and the card base 1AA while allowing the thermal head 13 to press the intermediate transfer film 11 on the card base 1AA. Additionally, the controller 6 operates to heat up the thermal head 13 to peel the ink receptor layer 11*d*1 and the protecting layer 11*c*1 (i.e. the transfer layer 11*cd*) in the first transcriptional region 21 from the release layer 11*b* and successively transfer (re-transfer) these layers 11*d*1, 11*c*1 to the card base 1AA (i.e. the first re-transfer process of the invention).

Consequently, the card 52 has the transfer layer 11*cd* in the first transcriptional region 21 re-transferred on the card base 1AA while positioning the ink receptor layer 11*d*1 inside the card 52 and the protecting later 11*c*1 on the front side of the card 52.

Next, it is performed to re-cue the re-transfer area on the card base 1AA and further cue the second transcriptional region 22 of the intermediate transfer film 11. Thereafter, as similar to the re-transferring of the first transcriptional region 21, it is performed to peel the ink receptor layer 11*d*2 and the protecting layer 11*c*2 (i.e. the transfer layer 11*cd*) in the second transcriptional region 22 from the release layer 11*b* and successively transfer (re-transfer) these layers 11*d*2, 11*c*2 onto the transfer layer 11*cd* in the first transcriptional region 21 previously transferred onto the card base 1AA (i.e. the second re-transfer process of the invention).

Figure 9:
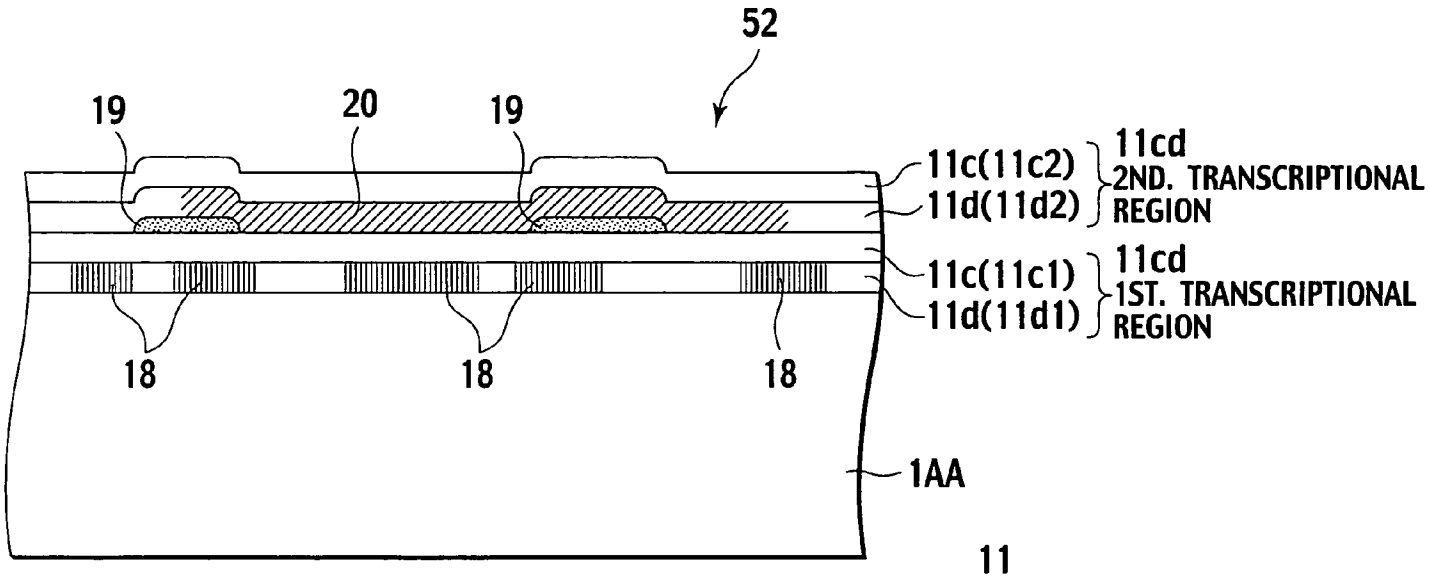
FIG. 9 is a sectional view showing a card in accordance with the second embodiment of the present invention.

Referring to FIG. 9, we now describe this re-transferring operation in superimposition although there are redelivered explanations. FIG. 9 is a schematic sectional view of the card 52 in accordance with the second embodiment of the present invention, showing the re-transfer areas transferred on the card base 1AA that correspond to the first and second transcriptional regions 21, 22.

First, the transfer layer 11*cd* (containing the sublimation-ink image 18) in the first transcriptional region 21 of the intermediate transfer film 11 is re-transferred to a designated re-transfer area on the card base 1AA. As a result, the ink receptor layer 11*d*1 and the protecting layer 11*c*1 both forming the transfer layer 11*cd* are laminated on the card base 1AA, in this order.

Next, the second transcriptional region 22 having the fusible-ink image 19 and the invisible-ink image 20 is re-transferred so as to overlap a card's portion to which the first transcriptional region 21 has been transferred previously.

The card 52 of the second embodiment is completed by the above-mentioned re-transfer processes.

According to the second embodiment of the present invention, the layer including the sublimation-ink image 18 is arranged close to the card base 1AA in comparison with the layer including the invisible-ink image 20 and additionally, the protecting layer 11*c*1 is interposed between the former layer and the latter layer.

Accordingly, as the sublimation-ink image 18 does not abut on the invisible-ink image 20 (image of ultraviolet emitting ink) directly, the light intensity of fluorescence, which is radiated from the invisible-ink image 20 onto the sublimation-ink image 18 in irradiating ultraviolet light in order to make the invisible-ink image 20 visible, is reduced in diffusion since the fluorescence is transmitted through the protecting layer 11*c*1, so that the color of the sublimation ink is restored to maintain the sublimation-ink image 18 in a good condition for a long period.

It is noted that if the ultraviolet emitting ink (fluorescent ink) makes contact with the sublimation ink, there is a possibility that the color degradation of the sublimation ink is accelerated due to the cross-reaction of both inks. However, according to the second embodiment, both of the ultraviolet emitting ink and the sublimation ink are separated from each other through the protecting layer 11*c*1, so that the color degradation of the sublimation ink can be prevented to maintain the sublimation-ink image 18 in a good condition for a long period.

Moreover, if the protecting layer 11*c*1 is mixed with either known ultraviolet absorbent or known ultraviolet diffusing agent, it is also possible to suppress an influence of ultraviolet rays on the sublimation-ink image 18.

Further, as the invisible-ink image 20 is arranged closer to the surface of the card 52 in comparison with the sublimation-ink image 18 and the fusible ink image 19, it is possible to make the fluorescence of the invisible-ink image 20 visible more clearly.

Modification of $2^{nd}$. Embodiment

Figure 11:
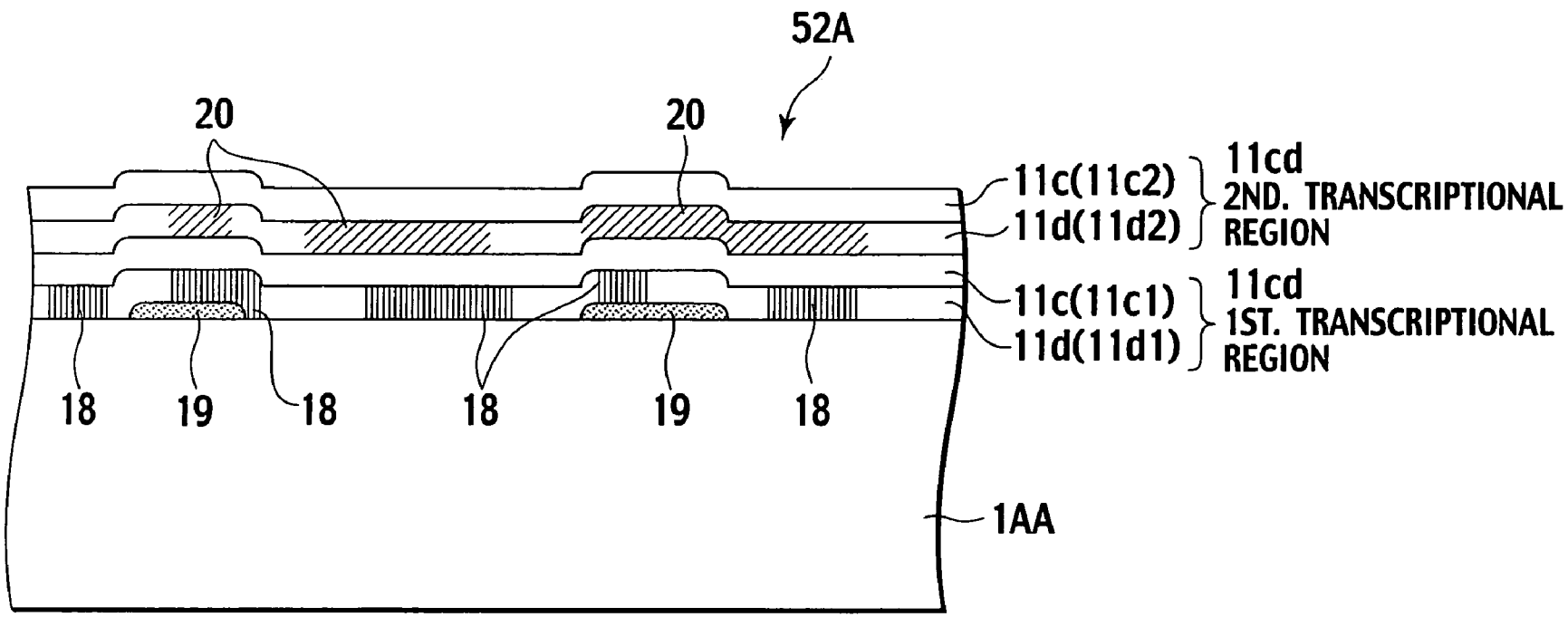
FIG. 11 is a sectional view showing a card of the modification of the second embodiment of the present invention.

FIG. 11 shows a card 52A in accordance with one modification of the second embodiment. The modification differs from the second embodiment in the re-transfer position of the fusible-ink image 19 in lamination.

Figure 10:
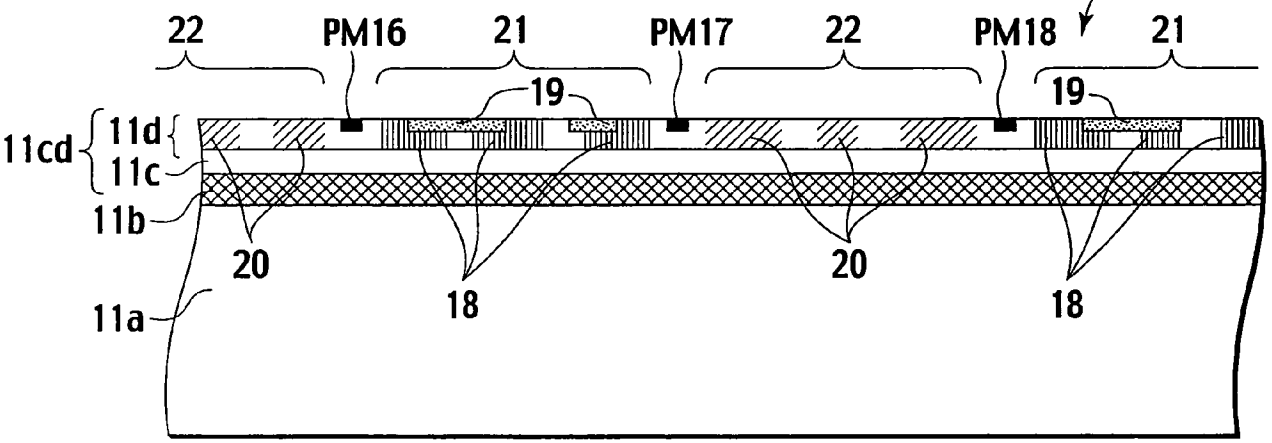
FIG. 10 is a sectional view explaining a transfer process in a modification of the second embodiment of the present invention.

We first describe the re-transfer process for the card 52A with reference to FIGS. 10 and 11.

First, respective ink images in the sublimation-ink layers Y, M, C are transferred from the ink film 33 (FIG. 6) to a designated first transcriptional region 21 of the intermediate transfer film 11, in piles. Consequently, as shown in FIG. 10, the sublimation-ink image 18 is formed in the ink receptor layer 11*d* in the first transcriptional region 21 of the intermediate transfer film 11.

Similarly, an ink of the fusible-ink layer K is transferred from the ink film 33 to the first transcriptional region 21 of the intermediate transfer film 11. As a result, the fusible-ink image 19 is formed on the front side of the ink receptor layer 11*d* in the first transcriptional region 21 of the intermediate transfer film 11.

On the other hand, an ink of the ultraviolet-emitting-ink layer UVS is transferred from the ink film 33 to the ink receptor layer 11*d* in the second transcriptional region 22 adjoining the first transcriptional region 21 of the intermediate transfer film 11 through a predetermined interval. As a result, the invisible-ink image 20 is formed on the front side of the ink receptor layer 11*d* in the second transcriptional region 22.

In this case also, respective positions for the first and second transcriptional regions 21, 22 containing the ink images 18~20 are established in the intermediate transfer film 11 previously. Further, the intermediate transfer film 11 is provided, between the first transcriptional region 21 and the second transcriptional region 22, with either the positioning mark PM16 or the positioning mark PM 17 for specifying the transcriptional regions 21, 22. These positioning marks PM16, PM17 are detected by the sensor 7C, while the controller 6 judges the positions of the marks on the basis of the detection signals from the sensor 7C.

The ink images 18~20 transferred to the intermediate transfer film 11 in the above way are transferred to the card base 1AA again (i.e. re-transfer operation).

This re-transfer operation will be described with reference to FIGS. 10 and 11. FIG. 11 is a schematic sectional view of the card 52A in accordance with the modification of the second embodiment, showing the re-transfer areas transferred on the card base 1AA that correspond to the first and second transcriptional regions 21, 22 substantially.

First, the transfer area 11*cd* in the first transcriptional region 21 of the intermediate transfer film 11 (containing the sublimation-ink image 18 and the fusible-ink image 19) is transferred to a designated re-transfer area of the card base 1AA, as shown in FIG. 11. As a result, the card base 1AA has the ink receptor layer 11*d*1 and the protecting layer 11*c*1 formed thereon and laminated in this order.

Here, it should be noted that the intermediate transfer film 11 had the fusible-ink images 19 positioned on the front side of the ink receptor layer 11*d*1. Therefore, in the card 52A, the fusible-ink images 19 are positioned on one side of the ink receptor layer 11*d*1 close to the card base 1AA.

Next, the transfer layer 11*cd* in the second transcriptional region 22 containing the invisible-ink image 20 is re-transferred from the intermediate transfer film 11 to the card base 1AA so as to overlap the previously-transferred first transcriptional region 21. Consequently, the ink receptor layer 11*d*2 containing the invisible-ink image 20 is interposed between the protecting layer 11*c*1 and the protecting layer 11*c*2 on the front side of the card 52A. In this way, the card 52A in the modification of the second embodiment is completed through the re-transfer process mentioned above.

According to the modification of the second embodiment, the layer including the sublimation-ink image 18 is arranged close to the card base 1AA in comparison with the layer including the invisible-ink image 20 and additionally, the protecting layer 11*c*1 is interposed between the former layer and the latter layer.

Accordingly, as the sublimation-ink image 18 does not come in direct contact with the invisible-ink image 20 (an image of ultraviolet emitting ink), the light intensity of fluorescence, which is radiated from the invisible-ink image 20 onto the sublimation-ink image 18 in irradiating ultraviolet light in order to make the invisible-ink image 20 visible, is reduced in diffusion since the fluorescence is transmitted through the protecting layer 11*c*1, so that the color of the sublimation ink is restored to maintain the sublimation-ink image 18 in a good condition for a long period.

It is noted that if the ultraviolet emitting ink (fluorescent ink) makes contact with the sublimation ink, there is a possibility that the color degradation of the sublimation ink is accelerated due to the cross-reaction of both inks. However, according to the second embodiment, both of the ultraviolet emitting ink and the sublimation ink are separated from each other through the protecting layer 11*c*1, so that the color degradation of the sublimation ink can be prevented to maintain the sublimation-ink image 18 in a good condition for a long period.

Moreover, if the protecting layer 11*c* (11*c*1, 11*c*2) is mixed with either known ultraviolet absorbent or known ultraviolet diffusing agent, it is also possible to suppress an influence of ultraviolet rays on the sublimation-ink image 18. Particularly, if the protecting layer 11*c*1 is mixed with either known ultraviolet absorbent or known ultraviolet diffusing agent, the above suppression can be effected with high efficiency.

Further, as the invisible-ink image 20 is arranged closer to the surface of the card 52A in comparison with the sublimation-ink image 18 and the fusible ink image 19, it is possible to make the fluorescence of the invisible-ink image 20 visible more clearly.

As for the above-mentioned embodiments and the modifications, we now exhibit materials available for respective inks and films, as follows.

- base sheet (3*a*, 33*a*) for ink films (3, 33): plastics (e.g. polyester, polypropylene, polyethylene) or condenser paper (thickness: 0.003 mm~0.010 mm)
- sublimation-ink layer: forming of disperse dyes in respective colors with resinous binder applied on base sheet (33*a*)
- fusible-ink layer: forming of carbon black (as color fixing agent) with resinous binder applied on base sheet (33*a*)
- first and second protecting inks OC1, OC2: acrylate resin, polyester resin, polyurethane resin, etc.
- invisible ink UVS: pigment (major components: crystal of metal oxides or sulfides) or organic compound as invisible (colorless) fluorescent material, and ultraviolet-fluorescent ink or infrared-fluorescent ink as invisible ink Note: In each case, preferably, the protecting layers OC1, 11*c* are made of material exhibiting low transmissivity against the wavelength range of fluorescence of the invisible ink.

base (11*a*) of intermediate transfer film (11): plastics (e.g. polyester, polypropylene, polyethylene) or condenser paper (thickness: 0.01 mm~0.05 mm)

release layer (11*b*): forming of thermoplastic resin (e.g. acrylate resin, polyester resin, polyurethane resin) plus mold-releasing material (as additive)

ink receptor layer (11*d*): polyester resin, polyvinyl resin, cellulosic resin, etc.

protecting layer (11*c*): polyurethane resin, acrylate resin, polyethylene resin, etc.

It will be understood by those skilled in the art that the foregoing descriptions are nothing but two embodiments and their modifications of the disclosed card, its manufacturing method and apparatus and therefore, various changes and modifications may be made within the contents of the present invention.

For instance, the fusible-ink images 9, 19 are not necessarily formed in the cards 51, 51A, 52 and 52A. Even if forming the fusible-ink image, there is no need to arrange the fusible-ink image and the sublimation-ink image (or the invisible-ink image) so as to overlap each other. Thus, the fusible-ink image may be arranged in an area different from the area containing the sublimation-ink image (or the invisible-ink image), out of the superimposition.

Further, as for the ink film 3 of the first embodiment (including the modification), the array of respective ink areas is not limited to the illustrated array only. Irrespective of any array of ink areas, the controller 6 of the card manufacturing apparatus 50 judges the sort of each ink area. Thereupon, the controller 6 controls the entire operation of the apparatus 50 so as to perform, at least in principle, the printing operation using the protecting ink after completing the printing operation using the sublimation inks and subsequently perform the printing operation using the invisible ink.

Similarly to the ink film 33 of the second embodiment (including the modification), the array of respective ink areas is not limited to the illustrated array only. Irrespective of any array of ink areas, the controller 6 of the card manufacturing apparatus 60 judges the sort of each ink area. Thereupon, the controller 6 controls the operation of the apparatus 60 so as to form, at least in principle, the sublimation-ink image 18 by superimposing sublimation inks on a designated area (the first transcriptional region) in the intermediate transfer film 11 and the invisible-ink image 20 in a different area (the second transcriptional region) from the above designated area (the first transcriptional region).

What is claimed is:

1. A card manufacturing method for manufacturing a card with use of an intermediate transfer film in which a protecting layer and an ink receptor layer are laminated on a strip-shaped base in this order, the intermediate transfer film having a first transcriptional region and a second transcriptional region defined in common with the protecting layer and the ink receptor layer, and an ink film having respective ink areas formed on a film base successively, the ink areas having a plurality of sublimation-ink areas in different colors and an invisible-ink area, the card manufacturing method comprising:

a sublimation-ink image forming process of transferring a plurality of sublimation inks in the sublimation-ink areas of the ink film to the ink receptor layer in the first transcriptional region of the intermediate transfer film in superimposition, thereby forming a sublimation-ink image in the intermediate transfer film;

an invisible-ink image forming process of transferring an invisible ink in the invisible-ink area of the ink film to the ink receptor layer in the second transcriptional region of the intermediate transfer film, thereby forming an invisible-ink image in the intermediate transfer film;

a first re-transfer process of re-transferring the ink receptor layer and the protecting layer in the first transcriptional region of the intermediate transfer film to a card base of the card so that the protecting layer in the first transcriptional region is arranged on a front side of the card; and a second re-transfer process of re-transferring the ink receptor layer and the protecting layer in the second transcriptional region of the intermediate transfer film onto the protecting layer in the first transfer are so that the protecting layer in the second transcriptional region is arranged on a front side of the card.

2. The card manufacturing method of claim 1, wherein the ink film further includes a fusible-ink area containing a fusible ink, and the card manufacturing method further comprises a fusible-ink image forming process of transferring the fusible ink to the ink receptor layer in the second transcriptional region, thereby forming a fusible-ink image.

3. The card manufacturing method of claim 1, wherein the ink film further includes a fusible-ink area containing a fusible ink, and the card manufacturing method further comprises a fusible-ink image forming process of transferring the fusible ink to the ink receptor layer in the first transcriptional region, thereby forming a fusible-ink image.

4. A card manufacturing apparatus comprising:

an ink film having respective ink areas formed on a film base successively, the ink areas having a plurality of sublimation-ink areas provided with a plurality of sublimation inks in different colors and an invisible-ink area provided with an invisible ink;

an intermediate transfer film in which a protecting layer and an ink receptor layer are laminated on a strip-shaped base in this order, a first detecting unit that detects the position of each of the ink areas of the ink film and outputs a first detection signal;

a second detecting unit that detects a feeding position of the intermediate transfer film and outputs a second detection signal;

a third detecting unit that detects a feeding position of a card base and outputs a third detection signal;

a first feeding unit for feeding the ink film based on the first detection signal;

a second feeding unit for feeding the intermediate transfer film based on the second detection signal;

a third feeding unit for feeding the card base based on the third detection signal;

a first transfer mechanism that presses the ink film against the intermediate transfer film and heats up the inks in the respective ink areas, thereby forming a transfer image in the ink receptor layer of the intermediate transfer film;

a second transfer mechanism that heats up the ink receptor layer having the transfer image formed therein and the protecting layer to re-transfer the ink receptor layer and the protecting layer to the card base; and a controller connected to all of the first detecting unit, the second detecting unit, the third detecting unit, the first feeding unit, the second feeding unit, the third feeding unit, the first transfer mechanism and the second transfer mechanism to control respective operations of the first transfer mechanism and the second transfer mechanism, wherein the controller controls the operation of the first transfer mechanism while controlling respective operations of the first feeding unit and the second feeding unit based on the first detection signal and the second detection signal so as to transfer the sublimation inks to the ink receptor layer in a first transcriptional region in the intermediate transfer film in superimposition thereby forming a first transfer image of the sublimation inks and further transfer the invisible ink to the ink receptor layer in a second transcriptional region in the intermediate transfer film, which is different from the first transcriptional region, thereby a second transfer image of the invisible ink; and the controller controls the operation of the second transfer mechanism while controlling respective operations of the second feeding unit and the third feeding unit based on the second detection signal and the third detection signal so as to re-transfer the ink receptor layer having the first transfer image formed therein in the first transcriptional region and the protecting layer to the card base and further re-transfer the ink receptor layer having the second transfer image formed therein in the second transcriptional region and the protecting layer onto the protecting layer in the first transcriptional region on the card base.

5. The card manufacturing apparatus of claim 4, wherein the ink film further includes an ink area of a fusible ink, and the controller controls the operation of the first transfer mechanism so as to form a third transfer image of the fusible ink in the ink receptor layer in the second transcriptional region and also controls the operation of the second transfer mechanism so as to re-transfer the third transfer image, the ink receptor layer having the second transfer image formed therein in the second transcriptional region and the protecting layer onto the protecting layer in the first transcriptional region.

6. The card manufacturing apparatus of claim 4, wherein the ink film further includes an ink area of a fusible ink, and the controller controls the operation of the first transfer mechanism so as to form a third transfer image of the fusible ink in the ink receptor layer in the first transcriptional region and also controls the operation of the second transfer mechanism so as to re-transfer the third transfer image, the ink receptor layer having the first transfer image formed therein in the first transcriptional region and the protecting layer to the card base.

* * * * *